US012569958B2

(12) United States Patent
Liske et al.

(10) Patent No.: US 12,569,958 B2
(45) Date of Patent: Mar. 10, 2026

(54) METHOD OF MONITORING A VIBRATORY GRINDING PROCESS

(71) Applicant: Rösler Holding GmbH, Bad Staffelstein (DE)

(72) Inventors: Marco Liske, Coburg (DE); Alexander Then, Stettfeld (DE); Franziska Täubert, Lichtenfels (DE); Stefan Thomann, Rentweinsdorf (DE); Rüdiger Böhm, Untermerzbach (DE); Christian Höhn, Niederfüllbach (DE); Marcus Henkel, Großheirath (DE); Conrad Schulz, Hallstadt (DE)

(73) Assignee: Röster Holding GmbH, Bad Staffeistein (DE)

( * ) Notice: Subject to any disclaimer, the term of this patent is extended or adjusted under 35 U.S.C. 154(b) by 473 days.

(21) Appl. No.: 17/571,626

(22) Filed: Jan. 10, 2022

(65) Prior Publication Data

US 2022/0226964 A1 Jul. 21, 2022

(30) Foreign Application Priority Data

Jan. 21, 2021 (DE) ..... 102021101245.7

(51) Int. Cl.

| | |
|---|---|
| ***B24B 49/08*** | (2006.01) |
| ***B24B 31/06*** | (2006.01) |
| ***B24B 49/00*** | (2012.01) |
| ***B24B 49/02*** | (2006.01) |
| ***B24B 49/14*** | (2006.01) |

(52) U.S. Cl.

CPC ..... *B24B 49/08* (2013.01); *B24B 31/06* (2013.01); *B24B 49/006* (2013.01); *B24B 49/02* (2013.01); *B24B 49/14* (2013.01)

(58) Field of Classification Search

None

See application file for complete search history.

(56) References Cited

U.S. PATENT DOCUMENTS

| | | | | |
|---|---|---|---|---|
| 5,795,212 | A | 8/1998 | Jacobs | |
| 11,407,079 | B2 * | 8/2022 | Stone | G06T 7/0004 |
| 11,701,829 | B2 * | 7/2023 | Hutchinson | B33Y 30/00 451/5 |
| 2016/0151874 | A1 * | 6/2016 | Jensen | B24B 31/023 134/184 |

FOREIGN PATENT DOCUMENTS

| | | | |
|---|---|---|---|
| CN | 87106434 | A * | 6/1988 |
| DE | 102011113167 | A1 | 3/2013 |
| DE | 102016103156 | A1 | 8/2017 |
| JP | 2020121388 | A | 8/2020 |

OTHER PUBLICATIONS

Machine translation of CN 87106434 A to Kobayashi, "Kobayashi Translation" (Year: 1988).*

German Search Report mailed Nov. 3, 2021 for German Application No. 10 2021 101 245.7, 7 pages.

European Search Report dated Jun. 27, 2022 for German Application No. 21 21 8001, 8 pages.

* cited by examiner

*Primary Examiner* — Monica S Carter
*Assistant Examiner* — Jonathan R Zaworski
(74) *Attorney, Agent, or Firm* — Dickinson Wright PLLC

(57) ABSTRACT

In a method of monitoring a vibratory grinding process, parameters from different parameter groups are detected and evaluated to output a command for operating the vibratory grinding system.

12 Claims, 2 Drawing Sheets

METHOD OF MONITORING A VIBRATORY GRINDING PROCESS

CROSS-REFERENCES TO RELATED APPLICATIONS

This patent application claims the priority of German Patent Application 102021101245.7, filed on Jan. 21, 2021, which is incorporated herein by reference, in its entirety.

FIELD

The present invention relates to a method of monitoring a vibratory grinding process in a vibratory grinding system and a possibly associated process water treatment system.

BACKGROUND

For many decades, vibratory grinding has proved its worth for processing components composed of the most varied materials, i.e. for deburring, rounding, polishing, etc. Within the framework of the present application, vibratory grinding is understood as any type of vibratory grinding process, for example plunge-cut grinding, drag finishing, treatment by means of vibratory grinding machines or centrifugal vibratory grinding machines, or the like.

In vibratory grinding, the workpieces are placed in a container which is filled with grinding bodies (process media) and which is flowed through by process water, wherein the process water is a mixture of water and additives (compounds in liquid, solid, or paste form). In operation, the grinding bodies and/or the workpieces are set into motion within the container such that a relative movement is produced between the grinding bodies and the components and the desired machining process is initiated. A vibratory grinding device therefore includes at least one device for a vibration and possibly a drive of spindles or workpiece carriers as well as various electrical devices such as sensors, heating elements, and the like.

The process water used in a vibratory grinding system, which typically includes water and compound in a concentration of approximately 1 to 2%, serves to generate material removal at the workpieces and to release residues, to wash off contaminants, and to flush them out of the vibratory grinding device. In the course of the process, the process media used are consumed and the process water becomes increasingly contaminated. It can therefore be fed to a process water purification system in which the process water is purified, recycled, and then returned to the vibratory grinding device. At the same time, solid particles and other co-discharged contaminants can be removed and separated from such a process water purification system by a chemical, mechanical, and/or physical treatment and also by centrifugation.

During the total process, disturbances can occur that impair a proper processing of the workpieces and that can also lead to a failure of all the devices involved. In this respect, the cause of such a disturbance is not always readily apparent or a cause is assumed for a disturbance, but is not primarily responsible for the disturbance.

SUMMARY

It is therefore the object of the present invention to provide a method and an apparatus for monitoring a vibratory grinding process in a vibratory grinding system by which disturbances in the operating sequence can be reliably recognized.

This object is satisfied by the features of the independent claims and in particular by a method in which, of at least three parameter groups of the vibratory grinding process, a respective at least one parameter is detected and supplied to an evaluation device. The evaluation device analyses the values of all the detected parameters and subsequently outputs a command for operating the vibratory grinding system by means of an output device. Of the three parameter groups, a first parameter group comprises at least one machine parameter, a second parameter group comprises at least one process water parameter, and a third parameter group comprises at least one process parameter. The machine parameter can, for example, be rotational speed, oscillation amplitude, temperature, energy consumption, and motor current of a machine operated in the vibratory grinding system. A process water parameter can, for example, be temperature, pH value, conductivity, refractive index, water hardness, compound concentration, foam formation, odor, or metering quantity of process chemicals. A process parameter can be filling level, workpiece quantity, process medium consumption, throughput time, process time, abrasion quantities, process medium wear, production quantity of the processed workpieces, or flow rate of liquids used.

In accordance with the invention, it has been recognized that a reliable process monitoring and a useful error detection can be achieved in that not only individual parameters, such as a filling level or a pH value, but also at least a respective one parameter of the parameter groups defined above can be detected and analyzed. It can only be prevented by such a holistic consideration of the vibratory grinding process that a wrong cause is associated with a present disturbance. For example, a disturbance in the process water treatment can have an effect on the machining of the workpieces. Conversely, however, a disturbance in the vibratory grinding process can also affect the process water treatment.

Advantageous embodiments of the invention are described in the description, in the drawing, and in the dependent claims.

In a first advantageous embodiment, at least one action instruction for an operator can be output as a command for operating the vibratory grinding system. Thus, after the detection and the determination of a deviation (analysis) of the parameters, the evaluation device can output one or more action instructions for an operator that, if followed, effect a disturbance-free process. Alternatively or additionally, the evaluation device can output at least one control command as a command by which one or more devices in the vibratory grinding system can be controlled. Thus, the action instruction to check a centrifuge in the process water purification system can, for example, be output as the command and the filling level in the vibratory grinding device can simultaneously be increased by a control command.

In accordance with a further embodiment, the detection of the parameters can take place by a manual input into an input device of the detection device. In this respect, an operator can read out individual parameter values from the system or determine them through measurements and input them into the input device.

Alternatively or additionally, in accordance with a further embodiment, the detection of the parameters can take place in an automated manner and can in particular take place continuously. In this way, various parameters such as the temperature of the process water, temperature of electrical aggregates, energy consumption, etc. can be transmitted in an automated manner to the evaluation device. If this takes place continuously, i.e. repeatedly and permanently, a deviation in the operating sequence can be recognized particularly well on the basis of previous specifications and measurement data in a disturbance-free operation. Furthermore, deviations of the detected parameters can also be used to output a command that certain components of the vibratory grinding system has to be maintained or replaced. In this way, it can be ensured at a very early stage that causes of disturbances are recognized and eliminated that would otherwise under certain circumstances only affect the vibratory grinding process to an intolerable extent at a later stage.

In accordance with a further embodiment, the command can comprise outputting an alarm message, whereby further damage to workpieces in the process and to components of the vibratory grinding system can be prevented.

In accordance with a further advantageous embodiment, a transmission of the parameters to the evaluation device can take place by remote data transmission. The parameters can hereby be transmitted wirelessly or in a wired manner to an evaluation device that is, for example, operated and maintained by the machine manufacturer.

In accordance with a further advantageous embodiment, a parameter, for example a process water parameter, can be detected in the second parameter group in that an operator performs a visual and/or olfactory assessment, wherein the result of this assessment is supplied to the evaluation device in the form of an assessment that can be preselected from a group. Thus, a group of assessments that describe a characterization of the process water can be made available to the operator, for example. Such a group can, for example, comprise the assessments transparent, translucent, milky, dirty, turbid, discolored, or the like, wherein the operator then selects one or more of these preselectable assessments and supplies them as process water parameters to the evaluation device. Similarly, an odor of the process water can be characterized in that one or more assessments are selected from a group that, for example, comprises the parameters odorless, oily, pungent, spicy, or the like.

Alternatively or additionally, in accordance with a further embodiment, a parameter can be detected by an image sensor and/or an odor sensor. Thus, the contents of a processing container and/or the process water in the process can, for example, be detected by means of a camera to recognize or exclude a foam formation or the process water can be analyzed by means of an odor sensor.

In accordance with a further advantageous embodiment, at least one machine parameter of a vibratory grinding device, a centrifuge, a pump, and/or a waste water purification apparatus can be detected in the first parameter group. Thus, for example, the rotational speed, the noise, or the temperature of electrical or hydraulic aggregates, the energy consumption, or the motor current of electrical aggregates, or the energy consumption of heating devices can be detected, wherein the electrical aggregates can be included both in the vibratory grinding device itself and in the process water treatment, process water purification, or waste water treatment. For a noise determination, knock sensors, microphones, or the like can be used. Signals from weighing apparatus, sensors, floats, control elements, conveyor belts, feeding apparatus, valves, or dryers can also be detected. It can also be monitored whether workpieces are properly held in a workpiece holder.

The following can also be detected or measured as process parameters: The sludge quantity of the grinding body abrasion, the workpiece temperature, for example via a thermal imaging camera, the humidity and/or temperature of drying air, the gloss level and/or roughness of the workpieces, the contour or rounding of the workpieces, the hardness or deformation of the workpieces, the cleanliness of the workpieces, the grinding pattern of the workpieces, the condition of grinding bodies. The workpiece throughput can also be monitored in order, for example, to determine whether all the parts supplied have also been removed from the vibratory grinding device again.

In accordance with a further advantageous embodiment, to output the command, the detected parameters of all three parameter groups can be correlated in the evaluation device. This means that no separate analysis of the parameters of the individual parameter groups takes place, but the parameters of all three groups are related to one another. Since a plurality of parameters often have to be readjusted to return to a control mode, in this embodiment, a systematic problem analysis is performed in accordance with an interaction scheme in accordance with the invention. Due to such a correlation, it is ensured that not only chemical influences, but also mechanical and electrical influences are investigated as possible causes. It is hereby also possible to distinguish primary causes from secondary causes.

In accordance with a further aspect, the present invention also relates to an apparatus for carrying out a method of the above-described kind, comprising an evaluation device that is connected to an input device and an output device, wherein the evaluation device is configured and adapted to detect at least one machine parameter, at least one process water parameter, and at least one process parameter of a vibratory grinding process of the vibratory grinding system, to analyze the detected parameters in a correlated manner through stored associations, dependences and limit values, and to output a command for operating the vibratory grinding system by means of the output device.

In accordance with an advantageous embodiment, to increase the degree of automation, the input device can be connected to a control unit, for example of a PLC control, of the vibratory grinding system and can read out at least one of the parameters from the control unit. It can hereby be ensured in a simple manner by corresponding interfaces that a large number of parameters anyway detected in the control unit are transmitted to the evaluation device.

In accordance with a further advantageous embodiment, the output device can be connected to a control unit of the vibratory grinding system and can output at least one control command for operating the vibratory grinding system to the control unit.

BRIEF DESCRIPTION OF THE DRAWINGS

The present invention will be described in the following purely by way of example with reference to an advantageous embodiment and to the enclosed drawing. There is shown.

DETAILED DESCRIPTION

Figure 1:
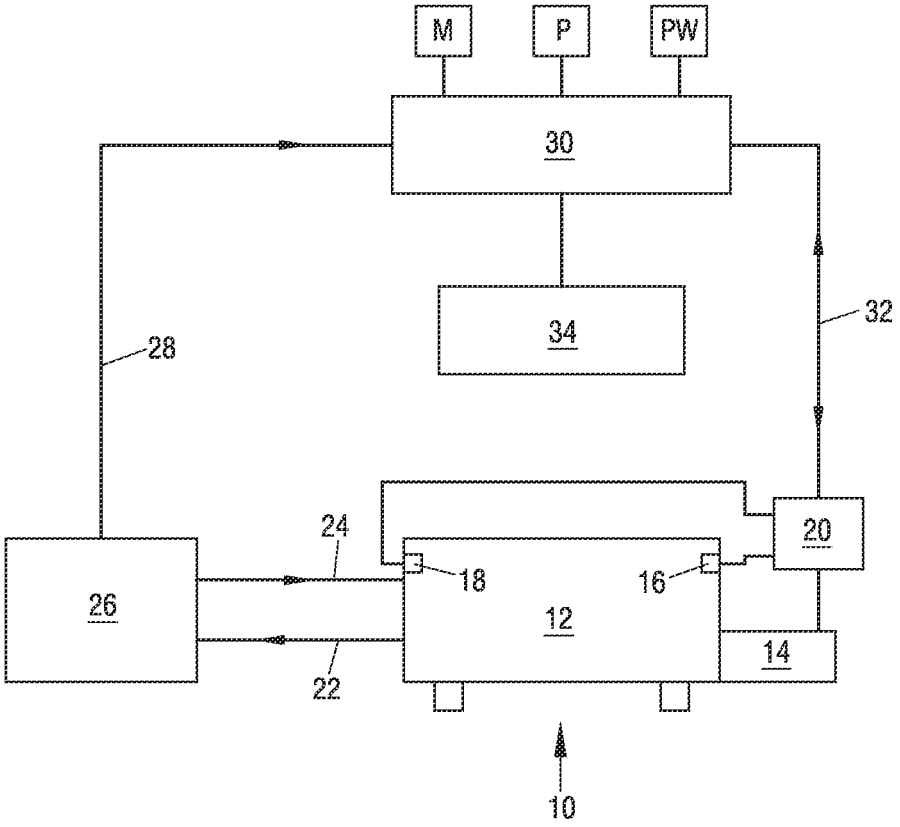
FIG. 1 a highly schematized vibratory grinding system with an apparatus for monitoring the vibratory grinding process.

FIG. 1 shows an exemplary vibratory grinding system having a vibratory grinding device 10 that comprises a container 12 that can be set into vibration by means of a vibration motor 14. The vibratory grinding device 10 further has various sensors, for example, a filling level sensor 16 and a temperature sensor 18.

A control unit 20 is provided for the operation of the vibratory grinding device, for example, a PLC control that is in communication with all the electrical components of the vibratory grinding device 10. Thus, the control unit 20 not only outputs control signals to control the vibration motor 14 and to determine the filling level or the temperature within the container 12. The control unit 20 rather also detects the temperature, the energy consumption, the current, and the rotational speed of the drive motor 14. Furthermore, the control unit 20 controls all the feed valves and outlet valves and other components of the vibratory grinding device 10.

The container 12 of the vibratory grinding device 10 is in communication with a process water treatment system 26 via a drain line 22 and a feed line 24, wherein the process water treatment system 26 includes further components such as a centrifuge, a fresh water tank, a dirty water tank, a stirrer, filling level sensors, metering devices, lifting stations, pumps, sensors, and the like. Thus, the appearance, the temperature, the pH value, the conductivity, the refractive index, the water hardness, the odor, the degree of turbidity, the degree of transmission, or also a foam formation of the process water can be detected in the process water treatment system 26, in the container 12, in the wastewater treatment or elsewhere, wherein different ones of these parameters can also be varied by adding compound agents, wastewater treatment products, or fresh water. All of the detected process water parameters are transmitted via a data link 28 to an evaluation device 30 that is connected to the control unit 20 of the vibratory grinding device 10 via a further data link 32. The evaluation device 30 is furthermore connected to input devices M, P, and PW, by which further parameters of the three parameter groups can be input or detected, and to an output device 34 by which the output of commands for the operation of the vibratory grinding system and the process water treatment system is possible, for example, in the form of an action instruction and/or as a control command.

In operation, the evaluation device 30 detects a respective at least one parameter from the group of machine parameters, process water parameters, and process parameters and analyzes the detected parameters in a correlated manner. Due to the linked examination and evaluation of the parameters of the electrical components and the process water circuit and the vibratory grinding process per se, commands for the further operation of the vibratory grinding system can be output that enable the operator to return to regular operation.

Figure 2:
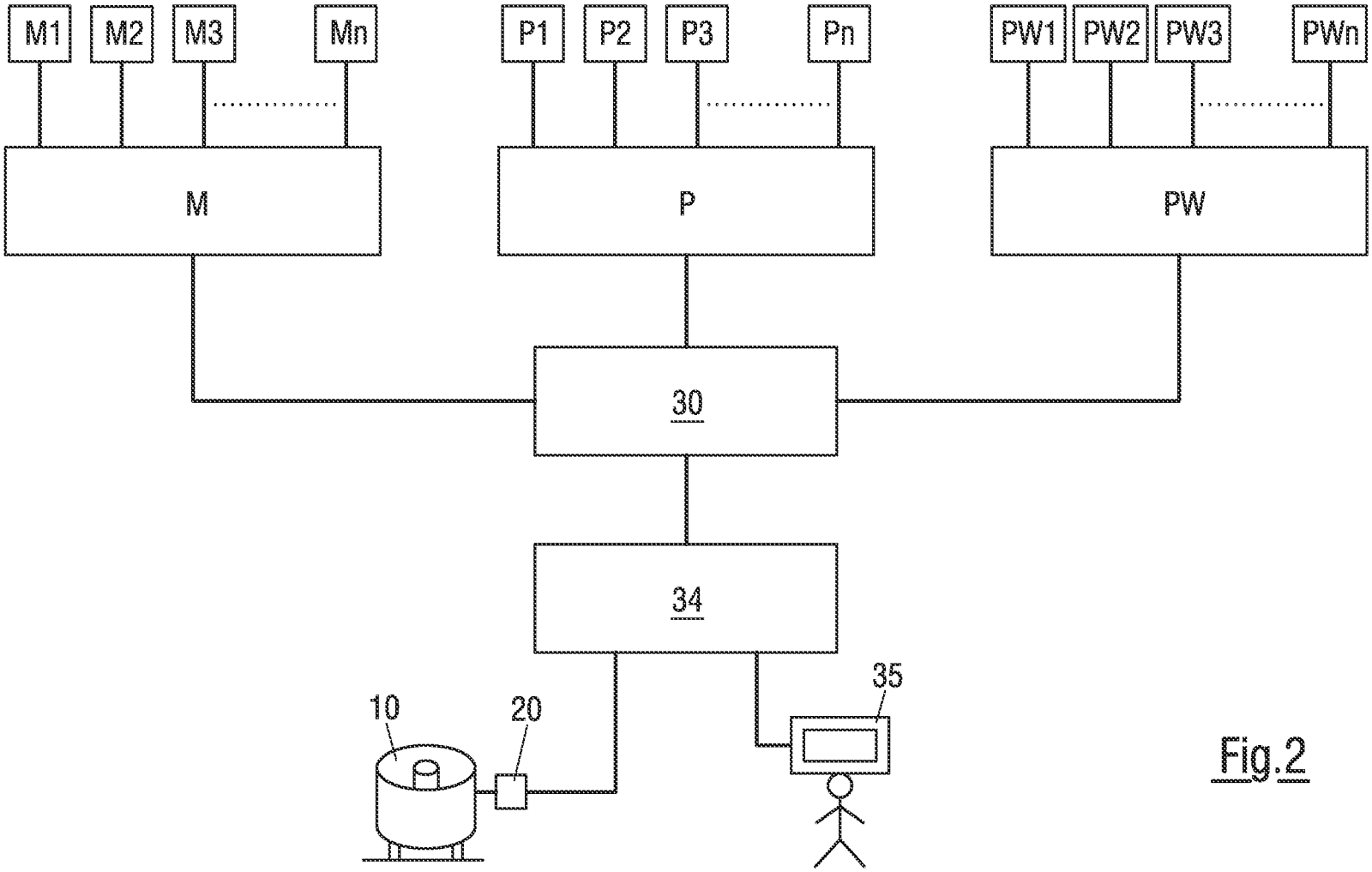
FIG. 2 a schematic diagram of a monitoring apparatus.

FIG. 2 shows a schematic representation of an apparatus for monitoring a vibratory grinding process. In this apparatus, an evaluation device 30 is again provided that receives parameters detected by a respective input device M, P, and PW. In this respect, machine parameters M1, M2, M3, . . . Mn are input into the input device M, while process parameters P1, P2, P3, . . . Pn are input into the input device P. Process water parameters PW1, PW2, PW3, . . . PWn are input into the input device PW.

A correlated evaluation of all the parameters of the three parameter groups is then performed in the evaluation device 30 and control commands are output to the control unit 20 of the vibratory grinding device 10 via a connected output device 34 or action instructions are output to an operator via a display 35.

Due to the correlated monitoring of the parameters from the three parameter groups described, it is possible to react to process anomalies. For example, it can be found in ongoing operation that the machine parameters of the input device M are within the prescribed limits, but that parameters are forwarded from the input device P and the input device PW to the evaluation device 30 that exceed or fall below predefined limits. Thus, it can, for example, be determined that not only the compound concentration is too low, but also that the grinding body quantity is below a predefined limit. Based on this check, the evaluation device 30 can then output the action instruction to add compound in the process water, on the one hand, and to increase the grinding body quantity, on the other hand.

It is understood that the method described above is only one example for correcting a process anomaly and that a plurality of limit values and correlations of the parameters are predefined in the evaluation device 30 so that a return to a regular operation can be made in the event of a process deviation.

What is claimed is:

1. A method of monitoring and controlling a vibratory grinding process, comprising:

providing a vibratory grinding system having a control unit configured in operable communication with a plurality of sensors and with a vibratory grinding device, the vibratory grinding device including a container configured to be set into vibration by a drive motor, and with a process water treatment system configured in communication with the container via a feed line and a drain line;

filling the container with process water from the process water treatment system;

detecting parameters of at least three parameter groups of the vibratory grinding process via the plurality of sensors;

analyzing and correlating the detected parameters of at least three parameter groups with an evaluation device and outputting at least one control command from the evaluation device to the control unit, the detected parameters of at least three parameter groups including a) a first parameter group consisting of at least one of a rotational speed and a temperature of the drive motor;

b) a second parameter group consisting of at least one of a conductivity and a degree of turbidity of the process water;

c) a third parameter group consisting of at least one of a process medium consumption and production quantity; and controlling and operating the vibratory grinding system in response to a control signal from the control unit, wherein the control signal is generated in response to the at least one control command from the evaluation device.

2. The method of claim 1, further including manually inputting detected parameters into an input device and configuring the input device in communication with the control unit.

3. The method of claim 1, further including detecting the parameters continuously in an automated manner.

4. The method of claim 1, further including transmitting the detected parameters to the evaluation device via remote data transmission.

5. The method of claim 1, further including configuring the vibratory grinding device to output an alarm message in response to a detected parameter falling outside a desired parameter range.

6. The method of claim 1, further including detecting a parameter in the second parameter group via a visual and/or olfactory assessment and supplying the result of this assessment to the evaluation device.

7. The method of claim 1, further including outputting at least one action instruction from the control unit as a command in response to the analyzed parameters, wherein the command comprises a request to an operator to initiate a maintenance of at least one component of the vibratory grinding system.

8. The method of claim 1, further including detecting at least one machine parameter of a vibratory grinding device, a centrifuge, a pump, and/or a waste water purification apparatus in the first parameter group.

9. An apparatus that performs the method of monitoring and controlling a vibratory grinding process of claim 1, comprising:

the vibratory grinding system of claim 1.

10. The apparatus of claim 9, wherein an input device is connected to the control unit of the vibratory grinding system and reads out at least one of the parameters from the control unit.

11. The apparatus of claim 9, wherein an output device is connected to the control unit of the vibratory grinding system and outputs at least one control command for operating the vibratory grinding system to the control unit.

12. The method of claim 1, further including detecting a parameter in of the second parameter group with an image sensor and/or an odor sensor.

* * * * *